US005096065A

United States Patent [19]

Vigue

[11] Patent Number: 5,096,065

[45] Date of Patent: Mar. 17, 1992

[54] MOLDED TRAY FOR HOLDING DIFFERENT SIZE CONTAINERS

[76] Inventor: Henry R. Vigue, 15 Barnet Ave., Waterville, Me. 04901

[21] Appl. No.: 731,352

[22] Filed: Jul. 15, 1991

Related U.S. Application Data

[63] Continuation of Ser. No. 661,248, Feb. 27, 1991, abandoned.

[51] Int. Cl.[5] ..... B65D 1/36

[52] U.S. Cl. ..... 206/564; 229/2.5 R; 229/904

[58] Field of Search ..... 229/2.5 R, 904; 206/564, 557

[56] References Cited

U.S. PATENT DOCUMENTS

| | | | |
|---|---|---|---|
| 3,915,371 | 10/1975 | Crabtree | 229/904 |
| 4,155,502 | 5/1979 | Forte | 229/904 |
| 4,218,008 | 8/1980 | Veilleux | 229/904 |
| 4,381,847 | 5/1983 | Bessett et al. | 229/2.5 R |

*Primary Examiner*—William I. Price
*Attorney, Agent, or Firm*—Connolly & Hutz

[57] ABSTRACT

A molded tray for holding different size containers includes a bottom wall and a peripheral side wall. The bottom wall is divided into two pair of oppositely arranged sockets with each socket being in a respective corner of the tray. One pair of sockets is constructed and dimensioned to hold containers in a certain size range while the alternate sockets are constructed and dimensioned to hold larger size containers.

19 Claims, 2 Drawing Sheets

MOLDED TRAY FOR HOLDING DIFFERENT SIZE CONTAINERS

This application is a continuation of application Ser. No. 661,248, filed Feb. 27, 1991, and now abandoned.

BACKGROUND OF THE INVENTION

The present invention relates to the field of articles or products designed to support individually a number of containers in an up-right position and more particularly the carrying or packaging trays which are molded to substantially finished form with horizontal and sloping wall portions to permit empty trays to be nested one within another in a compact and convenient stack for shipment and storage prior to use.

In particular the invention is directed to carrying trays which are particularly suitable for holding containers in fast food eating establishments.

Heretofore, molded trays have been used in fast food eating establishments by providing a tray with a plurality of sockets for holding one or more containers. Such trays are generally also provided with areas for holding other food items. U.S. Pat. No. 4,218,008 discloses a molded tray which is capable of holding two containers having a range of sizes. The sockets for holding the trays are provided adjacent each other at one end of the tray. The remainder of the tray is used for holding other items of food. With the recent growth in the fast food industry certain changes have restricted the true universal use of container carrying trays. For example, in fast food restaurants the smaller size container is generally an 8 oz. container and the sizes have increased up to 22 oz. While the tray of the '008 patent would be satisfactory for holding containers in the range of 8–22 oz. such trays are not suitable for larger size containers namely the 32 oz. beverage cup that is now in use in fast food restaurants. Another restriction in the design of suitable fast food trays is the necessity that the trays be dimensioned to slide through take-out windows. In practice, such windows are generally about 10½–11½ inches wide. Accordingly, a tray must be of lesser width to conveniently pass through the window. This presents difficulties in designing a tray capable of holding different size containers including the largest 32 oz. container.

SUMMARY OF INVENTION

An object of this invention is to provide a tray for holding different size beverage containers which overcomes the above problems presented in present day fast food establishments.

A further object of this invention is to provide such a tray which is capable of holding 32 oz. beverage cups as well as smaller size containers.

A still further object of this invention is to provide such a tray which may be conveniently passed through the take-out windows of such fast food establishments.

In accordance with this invention, a molded tray is provided which includes a bottom wall and upwardly sloping side walls which merge together at the four corners of the tray. A container holding socket is provided at each of the corners. The four sockets are arranged in two sets with a socket of each set being located opposite the other socket of that set. Each set of sockets is structured and dimensioned to be of different sizes so that one set is particularly designed for holding the jumbo size 32 oz. beverage container and smaller sizes while the other set is designed solely for holding smaller size containers.

In the preferred practice of this invention, each socket includes side stabilizing walls having inverted T-shaped openings to provide the necessary yieldability for effectively holding a container inserted therein. Preferably, three sets of inverted T-shaped openings are provided for each socket.

The central portion of the tray is preferably provided with a generally horizontal wall having a depression for adding strength to the tray.

THE DRAWINGS

DETAILED DESCRIPTION

Figure 1:
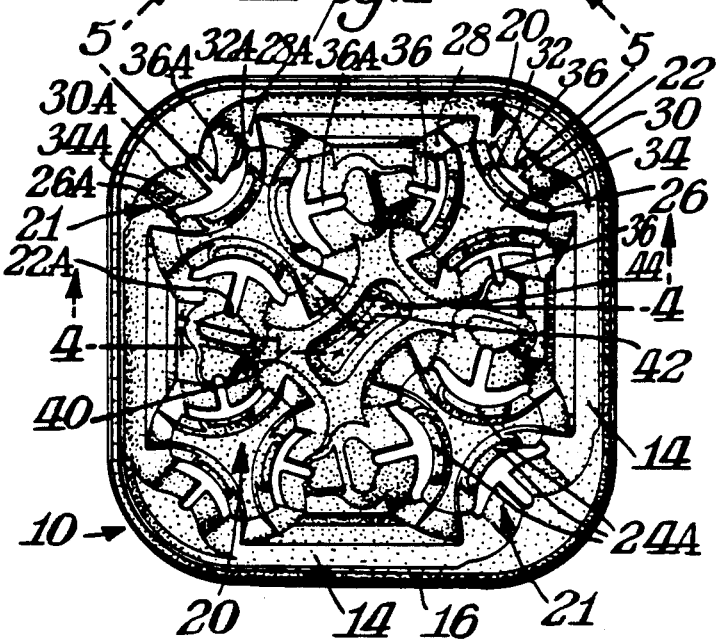
FIG. 1 is a top plan view of a molded tray for holding different size containers in accordance with this invention.
Figure 2:
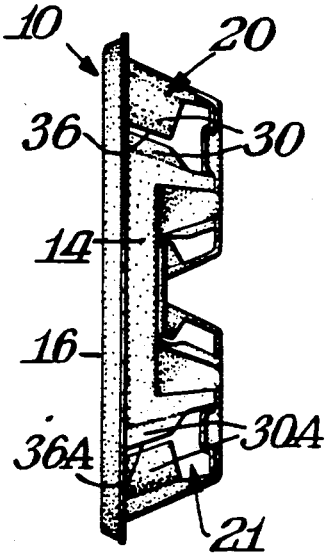
FIGS. 2–3 are side and end elevational views of the tray shown in FIG. 1.
Figure 3:
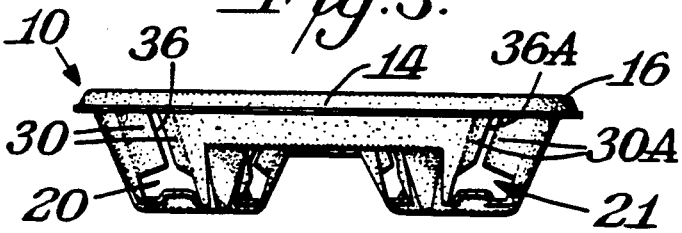
Figure 4:
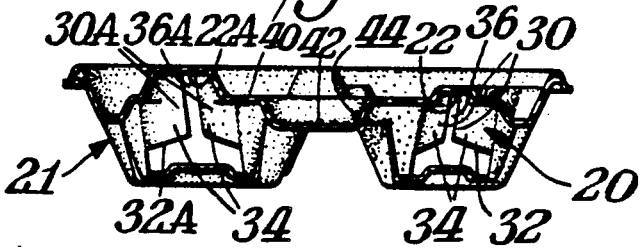
FIG. 4 is a cross-sectional elevational view taken through FIG. 1 along the line 4—4.

The present invention involves a unitary tray 10 which is molded to substantially finished form of resilient material such as fibrous material molded against screen-covered, open-faced, vacuum forming molds in a known manner. The tray 10, however, could also be molded to its finished form from foamed plastic or any other material having the requisite cost strength resiliency and other characteristics useful for trays of this type. The general structure of tray 10 is that it consists of horizontal wall portions and sloping wall portions but no substantially vertical wall portions so that a quantity of light empty trays could be stacked in nested fashion, one within another to provide compact stacks of such empty trays for economical shipment and convenient storage purposes prior to use.

The tray 10 comprises a generally rectangular tray having a flat bottom wall portion with upwardly and outwardly sloping side wall portions 14 and a downturned continuous flange 16. The tray 10 includes two sets of holding sockets 20,21 with each socket designed to hold a cup shaped container. The set of sockets 20,20 is arranged at opposite corners with the set of sockets 21,21 being arranged at the intermediate opposite corners. Sockets 20,20 are designed to hold containers within a predetermined size of ranges from as small as 8 oz. to up to 22 oz. Sockets 21,21 are made of larger size and thus can hold containers up to size 32 oz. and can hold smaller sizes. The sockets 20,21 are designed to hold conventional type containers which are circular in cross-section with slightly tapered sides and are made from paper or various plastic materials. The invention, however, may be practiced for holding containers made from other materials and other shapes.

Each container holding socket 20 comprises three horizontal stabilizing shoulders 22 positioned in spaced apart opposition to each other around the socket. In the illustrated embodiment the three shoulders 22 are spaced apart substantially equally around the socket although this is not an essential feature of the invention. Similarly, the invention could be practiced with four or more stabilizing shoulders provided the other operative features of the socket are not defeated. In the illustrated embodiment the operative portion of each of the three stabilizing shoulders 22 coincides with a circle of only very slightly greater diameter than the diameter of the widest size of container within the predetermined range which the socket is designed to accommodate. If such larger size container has tapered walls then the diameter is that which exists at the height of the container when fully inserted into the socket which is the same height as the shoulders 22 of socket 20.

Sockets 21,21 are structurally similar to sockets 20 except that socket 21 is of larger dimension. Accordingly, as used herein like parts for sockets 21 will have the same reference numerals as for sockets 20 except that the suffix A will be added to those parts for socket 21.

Figure 5:
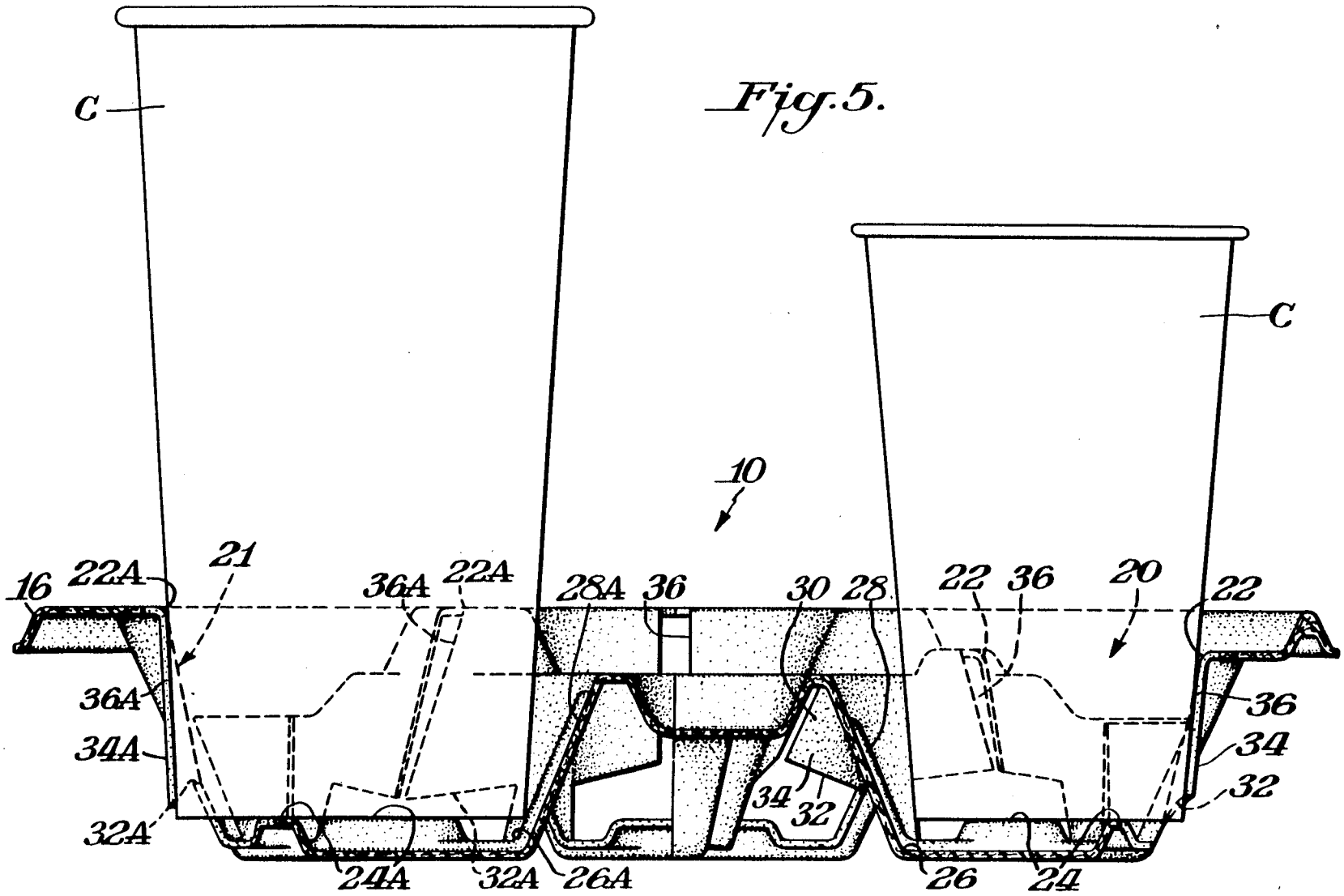
FIG. 5 is a cross-sectional elevational view taken through FIG. 1 along the line 5—5 showing different size containers in the tray.

As best illustrated in FIG. 5 the stabilizing shoulders 22 are located at a height significantly above the level occupied by the bottom of a container C fully inserted in the socket 20. The level is defined by a substantially horizontal bottom wall portion 24 which may take the form of a web connected as at 26 to sloping wall portions 28 of the tray 10 at three locations around the socket which are intermediate between the three stabilizing shoulders 22. Container C is thus elevated slightly above the bottom wall of tray 10.

The container holding socket 20 is further characterized by three inwardly contoured stabilizing walls 30 each of which extends downwardly beneath each of the respective shoulders 22. The stabilizing walls 30 extend downwardly to a height only slightly above the level defined by the upper surface of the bottom wall web 24. In the illustrated embodiment, stabilizing walls 30 extend downwardly to a height of about 1½ inches above that level while the stabilizing walls 30A extend to a height to about 2 inches above that level.

The stabilizing walls 30 are contoured inwardly to the extent that their lower portions 34 properly position at the least the narrow sizes of containers in the range of sizes which the socket is dimensioned to accommodate. In this sense the lower portions 34 of the three stabilizing walls act to center the container as it is being inserted and after being inserted into the socket. With narrower sizes of containers when the containers are fully inserted into the socket 20 so that the container bottom rests on the flat web 24, the lower portions 34 of the stabilizing walls provide a small amount of resilient pressure to insure that each container is properly supported in an upright position with its bottom on the flat web 24.

Stabilizing walls 30 are yieldable so that they or at least the lower portions 34 of walls 30 will be moved outwardly by but still support the intermediate or larger size containers. The yieldability of the stabillzing walls is controlled by several factors, such as the thickness, density and nature of the fibrous pulp or plastic material of which the trays and its stabilizing walls are made, the degree of curvature of the inwardly contoured portions of the stabilizing walls, the angle of slope of the innermost portions of the stabilizing walls with respect to the vertical, and the like.

Another means to control the yieldability of the stabilizing walls includes a vertically oriented slot 36 extending upwardly from the lower edge 32 of each stabilizing wall 30. The slot 36 in effect divides at least the lower portions 34 of the stabilizing walls into two separated container-contacting sections. In the illustrated preferred embodiment each slot 36 extends upwardly throughout the full vertical extent of the stabilizing wall and intersects the stabilizing shoulder 22. This in effect, divides the operative portion of each shoulder 22 into two sets of sections for contacting the wider sides of containers.

Each slot 36 accordingly forms, together with the opening beneath the lower edge 32 of each stabilizing wall, an inverted "T" shaped opening through the tray 10 beneath each stabilizing shoulder. In the preferred embodiment each slot 36 is of substantially uniform width throughout its fully vertically oriented extent, although a slot which is widened at its lower portions adjacent the lower edge 32 of the stabilizing wall would not defeat the operative principles of the present invention.

As illustrated, slots 36A are of larger dimension both in length and width than the corresponding slots 36.

In the illustrated embodiment the inverted "T" shaped opening which characterizes each stabilizing slot is not extensive and avoids the appearance of large apertures or holes in the tray. This improves the visual aesthetic appearance of the tray. Additionally, the three downwardly and inwardly oriented slots 36 associated with each socket serve to guide the bottom of a container as it is inserted vertically downwardly into the socket. This facilitates centering of the container as it is inserted and after insertion into the socket and also serves to apportion outward movement of the separated container-contacting sections of the stabilizing walls 30, particularly the lower portions 34 thereof.

The aforesaid means to control the yieldability of the stabilizing walls, including the slots 36 insure that the stabilizing walls, and at least the lower portions of them, may be easily moved outwardly by the intermediate sizes of containers, but in such a manner that the walls still will support such containers in the socket as illustrated in FIG. 5.

As illustrated, each shoulder 22 is integrally joined and merges into its adjacent shoulder 22A. Because of the difference in size, a step-like structure results wherein the four shoulders 22A extend above each adjacent shoulder 22. Each socket also includes a generally central top wall portion 40 which merge together and include a depression or recessed central portion 42 of generally elongated shape. Depression 42 is joined to top wall 40 by upwardly inclined side walls 44. This central structure functions for added strength to tray 10.

As illustrated in the drawings which are drawn to scale, tray 10 is of generally rectangular shape and is preferably 9.5 inches by 9.375 inches with an overall height of about 2.185 inches. The distance from each sloping wall directly across to central top wall 40 at each corner of sockets 21 is, example, about 3¾ inches while the distance from the corner of socket 20 to central wall 40 is about 3⅛ inches. As is best illustrated in FIG. 1 the individual sockets are somewhat pear shaped rather than being circularly shaped with the stabilizing walls forming indentations in the general curvature of the sockets. Because tray 10 has a width no greater than 9½ inches, tray 10 may readily slide through conventional take-out windows.

Tray 10 thus provides a single tray capable of holding four containers of differing sizes and more particularly a single tray capable of holding not only the conventional smaller size beverage containers but also the large size, such as the 32 oz. cups now in usage at fast food establishments. Accordingly, tray 10 comprises a universal type tray capable of holding containers over the entire range of sizes used in such fast food establishments. It should be appreciated that while sockets 21 are of a larger size than sockets 20, sockets 21 are also capable of holding the smaller size containers. Different size sockets, however, are incorporated in tray 10 so as to minimize the dimensions to facilitate the tray 10 being slid through a take-out window.

What is claimed is:

1. A molded tray for holding different size containers comprising a body member made of resilient material, said body member having a bottom wall and upwardly sloping side walls terminating in a peripheral rim, said body member being of rectangular shape with four corners, a container holding socket in each of said corners, said container holding sockets comprising two sets of sockets, said sockets of one of said sets being in opposite corners from each other with said sockets of the other of said sets being in the intermediate corners, one of said sets of sockets being larger than the other of said sets of sockets for holding larger containers therein, each of said sockets being defined by a plurality of spaced stabilizing walls, and each of said stabilizing walls having spaced resilient container contacting surfaces.

2. The tray of claim 1 wherein said stabilizing walls of each of said sockets are inclined upwardly and outwardly away from each other, and said container contacting surfaces being inverted "T" shaped openings through its said stabilizer wall.

3. The tray of claim 2 wherein said tray has a width no greater than 9½ inches.

4. The tray of claim 3 wherein each of said stabilizing walls terminates in a shoulder, and said shoulders in one of said sets of sockets extending higher than said shoulders in said other set of sockets.

5. The tray of claim 4 wherein said shoulders in said one set of sockets extend to about the height of said rim.

6. The tray of claim 5 wherein each of said sockets includes a shoulder in its respective corner, and the remaining shoulders of each of said sockets being joined back-to-back to a shoulder of an adjacent socket.

7. The tray of claim 6 wherein said shoulders merge into a generally central top wall, and said top wall having a central elongated recess.

8. The tray of claim 7 wherein each of said sockets is generally pear shaped.

9. The tray of claim 8 wherein each of said sockets includes a raised web.

10. A tray for holding a variety of different size container comprising a body member molded to a three dimensionally contoured shape from a resilient material, said body member having a series of joined aligning walls and a peripheral rim, said body member being of generally rectangular shape with four corners, a container holding socket formed by the sloping walls adjacent each of said corners, said containers holding sockets comprising two sets of sockets, said sockets of one of said sets being in diagonally opposite corners from each other and said sockets of the other of said sets being in the intermediate corners, the sockets of one of said sets being larger than the sockets of the other of said sets for holding the larger size containers therein, each of said sockets being defined by two sets of walls, each of said sets of walls comprising a plurality of spaced wall segments alternately arranged with respect to each other, and one of said sets of wall segments comprising container contacting surfaces which extend inwardly of the other of said sets of wall segments.

11. The tray of claim 10 wherein said container contacting surfaces of each of said sockets are inclined upwardly and outwardly away from each other, said container contacting surfaces having openings through its said wall, and each of said openings being of a larger dimension at its base than at its top.

12. The tray of claim 11 wherein each of said openings is of inverted "T" shape.

13. The tray of claim 12 wherein said tray has a width no greater than 9½ inches.

14. The tray of claim 13 wherein a portion of the bottom wall of each of said sockets is raised above the remainder of said bottom wall of said socket.

15. The tray of claim 14 wherein each of said sockets is defined by arcuate walls forming a non-circular shape in plan view.

16. The tray of claim 10 wherein said tray has a width no greater than 9½ inches.

17. The tray of claim 10 wherein a portion of the bottom wall of each of said sockets is raised above the remainder of said bottom wall of said socket.

18. The tray of claim 10 wherein each of said sockets is defined by arcuate walls forming a non-circular shape in plan view.

19. The tray of claim 10 wherein said generally rectangular shape comprises a first set of parallel edges perpendicular to a second set of parallel edges, and one of said sets of parallel edges being longer than the other of said sets of parallel edges.

* * * * *